United States Patent [19]

Sapp

[11] Patent Number: 4,776,908

[45] Date of Patent: Oct. 11, 1988

[54] METHOD OF REPAIRING A SKIMMER BOX AND PARTS USED THEREIN

[76] Inventor: Paul S. Sapp, 1143 E. Rovey, Phoenix, Ariz. 85014

[21] Appl. No.: 134,310

[22] Filed: Dec. 17, 1987

[51] Int. Cl.[4] ..... B32B 35/00

[52] U.S. Cl. ..... 156/94; 4/507; 52/169.7; 156/330; 206/582; 428/63

[58] Field of Search ..... 4/506, 507; 52/169.7, 52/514; 156/94, 330; 206/582; 428/63

[56] References Cited

U.S. PATENT DOCUMENTS 4,273,598 6/1981 Bowditch ..... 156/94

4,321,101 3/1982 Preiser et al. ..... 156/94 X 4,511,621 4/1985 Thomas et al. ..... 156/94 X

*Primary Examiner*—Robert A. Dawson

*Attorney, Agent, or Firm*—Warren F. B. Lindsley

[57] ABSTRACT

A method and associated kit of materials for repairing from above ground a ruptured skimmer box of a swimming pool wherein special fittings are cemented into waterlines connected to the skimmer box with the base of the box filled with an epoxy material. A diverter mounting ring is inserted above the epoxy material for providing a pathway for the water pipelines eliminated by epoxy material.

6 Claims, 2 Drawing Sheets

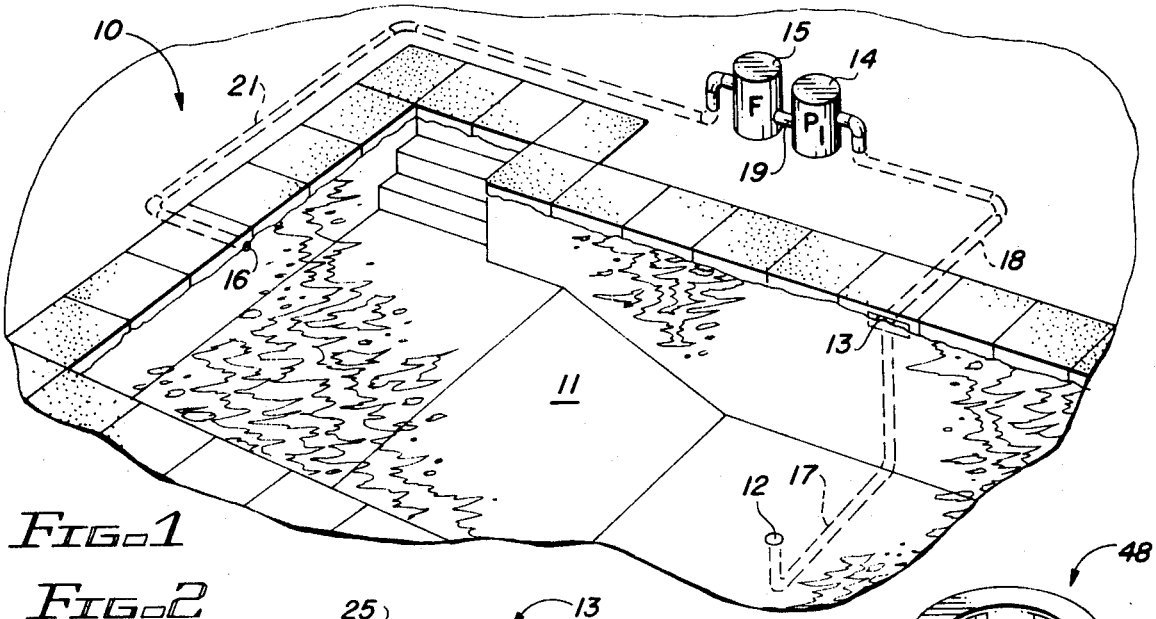
FIG. 1
FIG. 2
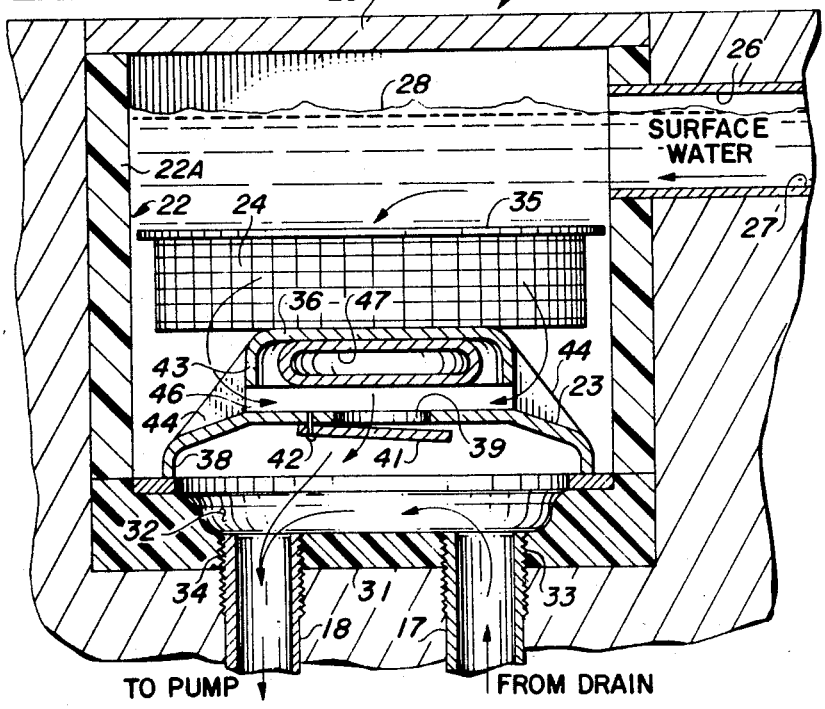
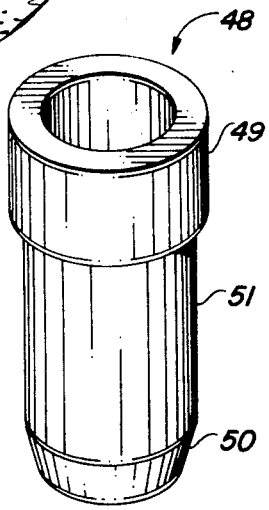
FIG. 5
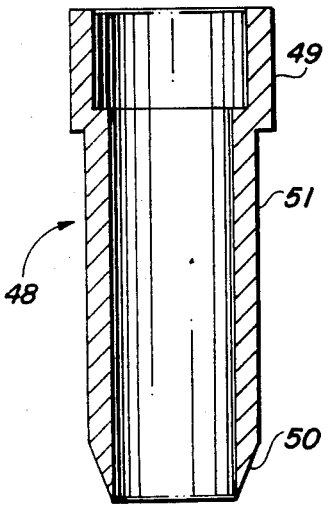
FIG. 6
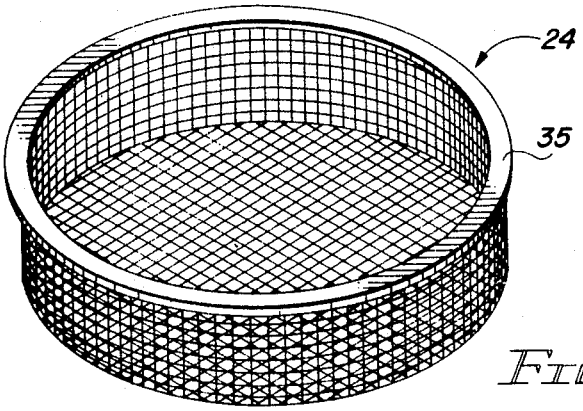
FIG. 3

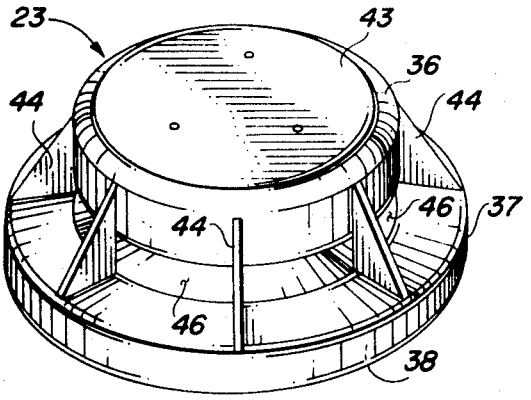
FIG. 4
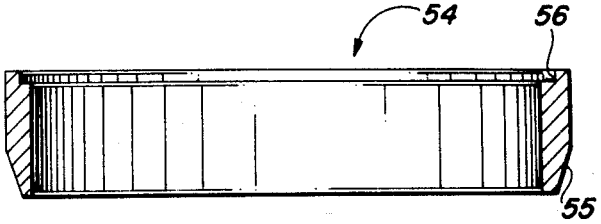
FIG. 8
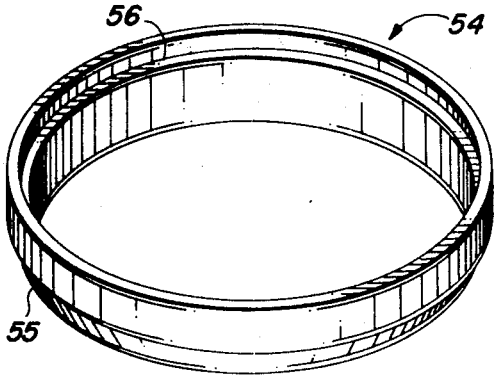
FIG. 7
FIG. 9
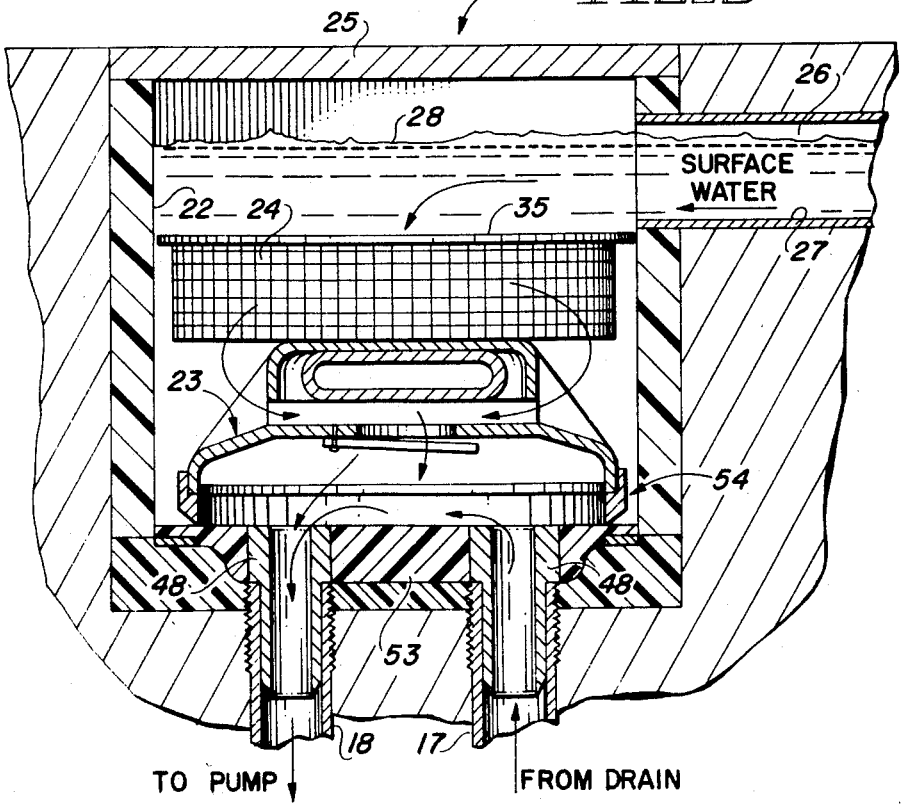

METHOD OF REPAIRING A SKIMMER BOX AND PARTS USED THEREIN

BACKGROUND OF THE INVENTION

The typical home swimming pool installation utilizes a filter unit mounted external to the pool itself through which the water from the pool is circulated to remove accumulations of dust, dirt and other foreign matter. In such an installation, water is drawn by the pump from two locations in the pool. For optimum removal of the heavier particles, a first point of removal is at the lowest point in the pool at the drain or sump; the second point of removal is at the skimmer which collects floating debris from the surface of the water. Water collected from these two points is pumped through the filter, and the filtered water is returned to the pool via a number of return ports distributed about the periphery of the pool.

A relatively common problem experienced by pool owners involves water leaks that develop at the skimmer. In some cases, the threaded connection of the plastic pipes connecting the skimmer to the pump loosen at or near the skimmer connection; in other cases, the bottom of the skimmer box itself develops leaks. Such faults may result from mechanical stresses produced by the settling of the surrounding soil or by chemical reactions which weaken the plastic materials of the skimmer assembly.

The repair of such a failure by ordinary methods is costly because of the labor involved. Because the plumbing connections to the skimmer are usually located under the pool decking, it is necessary to dig a trench under the decking to gain access to the work area to repair or replace the skimmer. After repairs or replacement are completed, the soil or gravel must be replaced.

The present invention provides a method for repairing such faults at the skimmer without having to dig for access to the failed parts. The invention also defines a kit of parts and materials required for the above ground repair of the faults.

SUMMARY OF THE INVENTION

In accordance with the invention claimed, a method and a kit of materials are provided for repair of ruptured parts of the skimmer assembly of a swimming pool. The method and the kit of the invention permit the repair of the ruptured parts from above ground and obviate the need for excavation beneath the pool decking.

It is, therefore, an object of the present invention to provide an improved method for repairing ruptured elements of a swimming pool skimmer assembly.

Another object of this invention is to provide a kit or set of parts and materials that is required for the execution of the improved method of repair.

A further object of this invention is to provide a method for repairing the skimmer assembly entirely from above ground without resorting to digging or excavating beneath the skimmer and the pool decking.

A still further object of this invention is to provide such a method which, together with the kit, renders the repair operation so simple to execute that the average pool owner will be able to perform the repairs personally, without professional help.

A still further object of this invention is to provide a method and the associated kit in a manner that produces reliable results so that the water leak will not soon redevelop.

Yet another object of this invention is to provide such a kit or set of materials at a low cost, so that it may be readily affordable by the average pool owner.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings,in which:

FIG. 1 is a perspective view of a swimming pool together with a simplified functional representation of the pump and filter system;

FIG. 2 is a cross-sectional view of a typical skimmer box;

FIG. 3 is a perspective view of the leaf basket that is used in the skimmer box of FIG. 2;

FIG. 4 is a perspective view of the diverter assembly employed in the skimmer of FIG. 2;

FIG. 5 is a perspective view of an insert extender which comprises one of the elements of the repair kit of the invention;

FIG. 6 is a cross-sectional view of the insert extender of FIG. 5, the cross section being made by a plane that passes through the longitudinal cylindrical axis of the part;

FIG. 7 is a perspective view of a diverter adaptor ring that is also included in the repair kit of the invention;

FIG. 8 is a cross-sectional view of the adaptor ring of FIG. 7, the cross-section being again taken through the cylindrical axis of the adaptor ring; and FIG. 9 is a cross-sectional view showing the skimmer of FIG. 2 after the repair method of the invention has been completed.

DESCRIPTION OF THE PREFERRED EMBODIMENT

Referring more particularly to the drawings by characters of reference, FIG. 1 illustrates diagrammatically a simplified swimming pool installation 10 comprising a swimming pool 11, drain 12, skimmer 13, circulation pump 14, filter 15 and a return port 16. A first water pipeline 17 connects drain 12 to skimmer 13; a second water pipeline 18 connects skimmer 13 to pump 14; a third water pipeline 19 connects pump 14 to filter 15; and a fourth water pipeline 21 connects filter 15 to return port 16.

In the operation of system 10, water from drain 12 flows through line 17 to skimmer 13. Water collected from the surface of the pool by skimmer 13, together with water from line 17, is carried by pipeline 18 to pump 14. From pump 14, the water flows through pipeline 19, filter 15, pipeline 21 and back to the pool via port 16. Dirt, dust and other contaminants collected at drain 12 and skimmer 13 are removed by filter 15 as the water is circulated by pump 14. There are typically several return ports similar to port 16 distributed about the periphery of the pool.

The construction and operation of skimmer 13 which is pertinent to the subject matter of the present invention is illustrated by FIG. 2 in which skimmer 13, shown for purposes of illustration but not intended to be a limitation because of its particular design configuration, is seen to comprise a skimmer box 22, a diverter 23 and a leaf basket 24.

Skimmer box 22 is cylindrical in form, and is ordinarily made of a suitable plastic material. It has a removable cover plate 25 at the top. Surface water from pool 11 enters box 22 through a horizontal opening 26, the lower surface 27 of which lies below the water surface 28 of the pool. Opening 26 extends above the water surface 28 of the pool so that floating debris can enter the skimmer box.

It should be noted that skimmer box 22 usually comprises a two piece configuration comprising a hollow cylindrical portion 22A having a base 31 secured thereto by gluing or a suitable mechanical bolt or screw connection (not shown). It is this connection, in addition to the threaded connection of lines 17 and 18 to base 31 where leaking has occurred.

Base 31 of box 22 has a recessed center that forms a centered circular depression 32. Base 31 is approximately ¾ inches thick in the region of depression 32 and two threaded openings 33 and 34 are provided therein for the connection of water lines 17 and 18, respectively, which are typically 1½ inch plastic tubing (PVC). The upper ends of the plastic tubing or fittings thereof, when installed in openings 33 and 34 may be slightly below the upper surface of depression 32. With lines 17 and 18 connected, as just described, depression 32 serves as a conduit for water flow from line 17 to line 18 and hence from drain 12 to pump 14.

Leaf basket 24, also shown in FIG. 3, is a circular or cylindrical basket, open at the top, with an outside diameter just smaller than the inside diameter of box 22. It is typically constructed of a wire mesh coated with synthetic rubber or plastic. Basket 24 thus fits snugly inside box 22. Its open upper periphery 35 is at a level lower than opening 26 so that water entering box 22 cannot pass to any portion of box 22 below basket 24 without passing through the leaf basket. The larger particles of debris, such as grass and leaves, are thus collected by basket 24 before they can reach pump 14 or filter 15.

Diverter 23, also shown in FIG. 4, is a two-level structure comprising an upper level 36 and a lower level 37.

Lower level 37 has the form of a shallow inverted dish with a circular, downward turned rim 38 that serves as a support for diverter 23. The diameter of diverter 23 at rim 38 is slightly smaller than the inside diameter of box 22. A circular opening 39 at the center of the inverted dish configuration of lower level 37 provides passage for water flow from upper level 36 to lower level 37. A cover 41 for blocking flow through opening 39 is pivotally mounted adjacent opening 39 by means of a screw 42. Cover 41 may be manually positioned to allow or prevent flow through opening 39.

Upper level 36 of diverter 23 comprises an inverted bowl 43 with an outside diameter that is about two-thirds the diameter of rim 38. Bowl 43 is supported above lower level 37 in a centered position by eight triangularly shaped struts or fins 44 that are uniformly spaced radially about bowl 43. The lower edge or rim 45 of bowl 43 is suspended above the surface of lower level 37 at a distance of approximately three-fourths of an inch. The resulting opening 46 immediately below rim 45 permits entry of surrounding water into diverter 23.

Confined within bowl 43 of upper level 36 is a float 47 in the form of a hollow plastic disc. The outside contours of float 47 approximate those of the interior of bowl 43, but the float is small enough in diameter that it is free to move vertically within bowl 43. The thickness dimension of float 47 is such that when float 47 rises due to floatation, it occupies only the space within bowl 43 that lies above rim 45 so that opening 46 is completely clear. When the water within box 22 recedes to the extent that float 47 settles to a position of rest upon lower level 37, opening 39 is closed. The closure is enhanced by a rubber or neoprene gasket (not shown in the drawings) that surrounds opening 39 on the surface upon which float 47 comes to rest.

The operation of skimmer 13 occurs as follows. In normal operation, surface water with floating debris enters opening 26, passing downward through basket 24 which retains the larger floating particles. Leaving basket 24 through its mesh base, the water flows around bowl 43 and enters diverter 23 via opening 46. Float 47 is in its elevated position so that opening 39 is clear. The flow of water thus proceeds through opening 39 into depression 32 and thence via line 18 to pump 14. Venturi forces produced by the flow of water around the lower surfaces of float 47 tend to pull float 47 downward to a degree proportional to the rate of flow. The water flow through the skimmer is thus regulated to some degree by diverter 23, so that a desired balance is achieved between the flow through the skimmer and the flow from drain 12.

With time, the corrosive action of pool chemicals tends to embrittle base 31 of box 22 causing it to leak at the connection of the cylindrical portion 22A to base 31 as heretofore explained. This embrittlement frequently causes base 31 in the presence of stresses produced by the settling of the earth surrounding lines 17 and 18 to loosen and leak at the threaded connection of lines 17 and 18 to openings 33 and 34 of base 31. These water leaks result in the loss of an undesirable amount of water from the pool, as well as the introduction by suction of air through these loose connections into the piping system at the point of leakage.

The corrective method of the present invention involves the filling of depression 32 and the inside of the bottom of box 22 so as to cover the point of connection of the cylindrical portion 22A to the base 31 of box 22 with an epoxy material, thereby reinforcing the base of box 22, including the external connections of lines 17 and 18 to openings 33 and 34. To assure a satisfactory method for the accomplishment of these measures, a special fitting is provided in the form of insert extender 48, shown in Figs. 5 and 6.

Insert extender 48 may comprise a one-piece plastic fitting with a head portion 49 and a body portion 51. Head and body portions are both cylindrical, with head portion having an inside diameter which may be 1¾ inches and body portion having an inside diameter which may be ¾ of an inch. The wall thickness of head portion 49 may be somewhat less than the wall thickness of body portion 51. The outside diameter of body portion 51 is just smaller than the inside diameter of lines 17 and 18 connected at openings 33 and 34 at the base of box 22. The transition from body portion 51 to head portion 49 is a step change so that a ninety degree shoulder is formed. The length of body portion 51 is two to three inches; the length of head portion 49 is approximately equal to the depth of depression 32 plus ½ inch to cover the connection of portion 22A to base 31 at the base of skimmer box 22. The lower or outer end 52 of body portion 51 is tapered.

As shown in FIG. 9, two of the insert extenders 48 are employed to repair skimmer box 22. The first is installed and cemented into the connected end of line 17, the second is cemented into the connected end of line 18. In both cases, the body portions 51 of the insert extenders are inserted into the associated pipeline. The shoulder formed at the transition from the body to the head portion serves as a stop so that only the head portion extends above the surface of depression 32. The tapered end 50 of body portion 51 facilitates the installation.

Following the installation of insert extenders 48, depression 32 is filled with an epoxy material 53. The extending heads 49 of insert extenders 48 serve as guides for the epoxy filling operation; they also guard against the spilling of the epoxy material into lines 17 and 18 during the filling operation. Depression 32 is filled with the epoxy material to a level that is flush with the top edges of insert extenders 48 and covering the sealed connection of the cylindrical portion 22A of box 22 with its base 31.

It will be noted that the filling of depression 32 with epoxy eliminates the conduit for water flow from line 17 to line 18 that had been previously provided by depression 32. A new conduit must now be provided for that purpose.

The method provided in the present invention involves the elevation of diverter 23 through the use of a diverter mounting ring 54, shown in FIGS. 7, 8 and 9. As shown in FIGS. 7 and 8, ring 54 is actually a short cylinder with a tapered lower edge 55 that permits its lower edge to clear obstructions at the lower outer corners of box 22. Ring 54 is preferably made of a plastic material such as PVC.

Ring 54 is intended to be attached to rim 38 at the base of diverter 23. As shown in FIGS. 7, 8 and 9, the inside edge of ring 54 has an indentation 56 that receives the outer edge or periphery of rim 38 when ring 54 is attached to rim 38. The thickness or height of ring 54 is approximately equal to the depth of depression 32, so that when ring 54 is attached to the base of diverter 23, as shown in FIG. 9, and diverter 23 is then placed into position over the repaired base of box 22, the volume enclosed by ring 54 serves as a new conduit just above the surface of epoxy material 53 for the flow of water from line 17 to line 18. The elevation of the diverter leaves less space between the top of the diverter and the skimmer inlet opening 26 for the leaf basket. In such cases, it is necessary to provide a more shallow leaf basket. These are commercially available.

The recommended repair kit and the step-by-step procedure in accordance with the invention are as follows:

KIT

| Item | Quantity |
|---|---|
| Insert extender | 2 |
| Diverter mounting ring | 1 |
| Shallow leaf basket | 1 |
| *One quart epoxy kit | 1 |
| **One-half pint Weld-On #711 | 1 |

*For example: Helor Hi-Water Concrete Adhesive Epoxy Coating Co. Union City, CA 94587

**For example: Weld-On #711 Plastic Pipe Cement Industrial Polychemical Service Gardena, CA 90248

PROCEDURE

1. Check to be sure that fittings of pump and drain lines at base of skimmer box receive insert extenders in a snug fit.
2. Drain pool to a level approximately four inches below the bottom of the skimmer.
3. Using a syringe or other means, remove water from pump line to a level at least three inches below the base of the skimmer.
4. Using a "blow-dry" hair dryer, dry the base of the skimmer and the openings into the pump and drain lines at the base of the skimmer.
5. Using the #711 Weld-On, coat the outside surfaces of the insert extenders and the inside surfaces of the pump and drain openings.
6. Insert the insert extenders into the openings making sure that the shoulders at the bottoms of the head portions of the insert extenders are "bottomed out" on the skimmer base.
7. Mix the epoxy in a clean container. Prewarming of this material is recommended in cold weather.
8. Coat the exposed outside surfaces of the insert extenders and the surfaces of the depression in the base of the skimmer box with the #711 Weld-On.
9. Pour the epoxy mixture into the areas of the skimmer box depression surrounding the exposed portions of the insert extenders, filling to a level flush with the top edges of the insert extenders. Take care not to overfill or spill the material into the pump or drain lines.
10. Using the #711 Weld-On, coat the mating surfaces of the diverter and the diverter mounting ring, then assemble the two parts together and allow cement (Weld-On) to cure.
11. After twelve hours, install diverter with attached mounting ring in skimmer box, install the shallow leaf baske over the diverter, refill pool, and return to service.

A repair method and an associated kit have thus been provided for repairing a leaking skimmer box in accordance with the stated objects of the invention.

Although but a single embodiment of the invention has been illustrated and described, it will be apparent to those skilled in the art that various changes and modifications may be made therein without departing from the spirit of the invention or from the scope of the appended claims.

What is claimed is:

1. A method for repairing the base of a leaking cylindrically shaped skimmer box assembly of a swimming pool wherein the assembly at its base forms a fluid connection for two pool water circulating pipelines that terminate in the base of the assembly and a diverter that passes a regulated amount of pool surface water therethrough into said connection comprising the steps of:

cementing insert extenders in the terminating ends of the two pipelines inside the assembly with the exposed ends of the extenders positioned a similar predetermined distance above the base of the assembly, filling the base of the assembly with an epoxy material to a level flush with the exposed ends of the extenders, placing a cylindrical ring of a given axial length on top of the surface of the set epoxy material, and mounting a diverter on the exposed end of the cylindrical ring which forms a closed compartment which connects the two pipelines, said diverter introducing a controlled amount of surface pool water into said compartment.

2. The method set forth in claim 1 in further combination with the step of:

coating the exposed outside surfaces of the extenders with a plastic pipe cement prior to the filling of the base of the assembly with the epoxy.

3. The method set forth in claim 1 wherein:

the extenders are cylindrical pipes having a collar on each of the exposed ends which seats in the pipes on the base of the assembly.

4. The method set forth in claim 1 wherein:

the epoxy comprises a concrete adhesive.

5. The method set forth in claim 2 wherein:

the coating comprises a plastic pipe cement.

6. A kit for repairing from above ground the base of a ruptured skimmer box of a swimming pool, said skimmer box having a recessed base, first and second waterlines terminating in said recessed base, a diverter module mounted directly above said waterlines in said box, a leaf basket mounted directly above said diverter module, and a skimmer inlet opening in said box located above said leaf basket and opening into the swimming pool, said first waterline being connected to a circulating pump of the swimming pool, and said second waterline being connected to a drain of the swimming pool, said kit comprising a diverter mounting ring, two insert extenders, a quantity of epoxy material and a cement for joining plastic materials, said diverter mounting ring comprising a short cylinder approximately dimensioned and notched at its upper edge to receive and be cemented to the base of said diverter module for forming thereunder a conduit for the flow of water from said second waterline to said first waterline, each of said insert extenders comprising a cylindrical plastic fitting having a body portion and a head portion, said body portion having an outside diameter that fits snugly within either of said first or second waterlines, and said head portion having an outside diameter greater than the inside diameters of said waterlines and a length approximately equal to the depth of the depression in said recessed base of said skimmer box plus approximately one half an inch, said insert extenders being intended for insertion into said waterlines at their connections to said base of said skimmer box, said plastic cement being intended for cementing said diverter mounting ring to the base of said diverter module, and for cementing said insert extenders into said waterlines at their connections to said base of said skimmer box, and said epoxy material being intended to fill in the depression in said recessed base of said skimmer box in the areas surrounding said head portions of said insert extenders, thereby covering and sealing off the ruptured areas of the base of said skimmer box.

* * * * *